United States Patent [19]

Weisgerber

[11] Patent Number: 4,781,370

[45] Date of Patent: Nov. 1, 1988

[54] SHEET GRIPPING APPARATUS

[75] Inventor: Willi Weisgerber, Geisenheim-Johannisberg, Fed. Rep. of Germany

[73] Assignee: Miller-Johannisberg, Druckmaschinen GmbH, Weisbaden-Biebrich, Fed. Rep. of Germany

[21] Appl. No.: 28,675

[22] Filed: Mar. 20, 1987

[30] Foreign Application Priority Data

Nov. 7, 1986 [DE] Fed. Rep. of Germany ..... 3623405

[51] Int. Cl.[4] ..... B65H 5/14

[52] U.S. Cl. ..... 271/277; 271/82

[58] Field of Search ..... 271/82, 206, 277

[56] References Cited

U.S. PATENT DOCUMENTS

| | | | |
|---|---|---|---|
| 2,509,030 | 5/1950 | Banthin | 271/206 |
| 3,650,211 | 3/1972 | Nentwich | 271/82 X |
| 4,224,873 | 9/1980 | Wieland | 271/82 X |
| 4,448,125 | 5/1984 | Kawaguchi | 271/82 X |
| 4,592,279 | 6/1986 | Kemmerer | 271/82 X |

*Primary Examiner*—Richard A. Schacher

*Attorney, Agent, or Firm*—Carothers & Carothers

[57] ABSTRACT

This invention concerns a sheet gripper for sheet processing machines, especially for single- and multi-color printing presses of random printing processes as well as for numbering machines, coaters, folders, and similar apparatus. To permit interchange of one of several sheet grippers for another without removing the gripper spindle from the machine, the sheet gripper is formed with an open portion which encloses the gripper spindle through a maximum arc of 180° and is fixedly retained in radially centered relation against the gripper spindle by a gripper lifter or carrier, also referred to as a drive dog, which is fixedly secured to the gripper spindle as by means of a screw or other removable fastener which extends through the drive dog or carrier and into the gripper spindle. A compression spring located to one side of the gripper spindle and an adjustment screw located to the opposite side thereof both cooperate with contact surfaces of both the sheet gripper and the drive dog to permit adjustment for centering of the sheet gripper.

7 Claims, 5 Drawing Sheets

SHEET GRIPPING APPARATUS

BACKGROUND OF THE INVENTION

This invention concerns a sheet gripper for sheet-processing machines, especially for single- and multi-color sheet-fed printing presses of random printing systems, e.g. sheet offset presses, sheet gravure presses, sheet letter presses and the like, as well as for numbering presses, coaters, folders and other such apparatus. For purposes of simplicity, the following description will refer to sheet fed printing presses and it will be understood that the invention is likewise applicable in the above-mentioned and other sheet-processing machines.

The sheets to be printed, often called print carriers, are transferred in such a machine, often repeatedly as in multi-color presses, from one cylinder to another by means of sheet gripper systems. Because in such printing presses different colors are printed by different printing units, and because several such cylinder gripper transfers may be necessary between the printing zone of one printing unit and the printing zone of the subsequent printing unit, flawless operation of the sheet grippers is essential. In presses with in-line setup, for example, generally two or four gripper transfers are required. In a sheet rotary offset printing press, the impression cylinder takes over the sheet or print material from the in-feed system in the first printing unit, guides the sheet through the first printing zone between the blanket cylinder and the impression cylinder, and then transfers it in the tangential area between the impression cylinder and the transfer cylinder to the transfer cylinder. The same process is repeated from cylinder to cylinder through the complete press period. In a C-6 press of this design, there are altogether 22 gripper systems, each with a multitude of individual grippers.

Proper transfer of print material from cylidner to cylinder in such machines is important to assure good printing quality, and achieving this goal is especially dependent on the gripper systems of the various cylinders. In the complete gripper system, the individual sheet grippers play an important roll because there are many of them in the press and for each one consistency of operation with respect to durability, the position of the gripper tip with respect to the gripper pad, the contact area of the gripper tip, and easy movement of the gripper shaft all must be assured.

Gripper systems of the highest stability and precision are necessary to transport the sheets without the slightest misalignment from printing zone to printing zone. Additionally, operation of the individual sheet grippers must be very consistent. In offset printing presses, for example, the necessary pulling force, that is the force necessary to pull the sheet from the printing gap, is one kg. per cm. of sheet width. This means a force of approximately 8 to 10 kg. per gripper because not every cm. of sheet width can be gripped. In no case may the sheet move in the gripper during the printing process or on the transport, lest such movement result in misalignment of the print carrier. Further, since the sheet grippers are wear elements, they must be exchanged for new or refurbished grippers from time to time. Because of the large number of sheet grippers, it is of utmost importance that the sheet gripper exchange operation be as simple and quick as possible, and that it not require highly skilled workers. These requirements are not fulfilled by the sheet gripper designs known heretofore.

German patent document DE PS No. 23 07 126 shows a gripper which is constructed like most of the usual sheet grippers for sheet-fed printing presses; it is different only by the kind and mode of changeability of the holding force. A disadvantage of the construction disclosed in the cited German patent document is that a clamping piece must be slid with its bore onto the gripper spindle, and that is very akward when there are 10 to 20 sheet grippers on the gripper spindle. The gripper spindle itself is supported by several bearing blocks distributed over its length, and the clamping pieces of the sheet grippers and the bearing blocks therefore must be lined up on the gripper spindle in a specific sequence. The gripper itself encloses the clamping piece and must also be threaded onto the gripper spindle with its two hubs. Before the complete sheet gripper assembly is lined up, the clamping piece must be inserted between the two hubs of the gripper and must be slid onto the gripper spindle together with the aligned bores. For this, the gripper spindle must be removed from the cylidner, wnich is quite disadvantageous when it becomes necessary to exchange all or individual ones of the grippers. Depending on the print material to be processed, and on the format, the intervals at which the grippers must be exchanged may be shorter or longer. Also, it happens from time to time that an individual gripper becomes defective due to outside influences and then must be exchanged. In these instances only a factory mechanic or service man has been able to carry out the work because of the difficulty of such an exchange.

In the above referenced conventional system, gripper exchange requires the gripper spindle bearing blocks, with the gripper spindle and the can lever, spindle springs, and so forth, all to be removed from each cylinder. In a multi-color press this can amount to up to 25 impression- and transfer-cylinders in which the complete gripper spindles must be removed and reinstalled for gripper exchange. The exchange operation thus results in the expensive press being down for approximately several days and the costs of gripper exchange become very high.

A further disadvantage of this conventional system can be that prior gripper designs often have been very heavy, to the detriment of performance due to the resultant high mass forces. The gripper spindle, with the many complete sheet grippers, must complete, for each gripping operation, a swivel motion of approximately 20° in just a few milli-seconds. In view of the targeted further increases in production rates of printing presses, every single gram of reduced gripper weight is beneficial.

Still another disadvantage of the cited prior gripper design is that a change in the holding or gripping force, by means of the adjusting screws designed for this purpose, also changes the positional relationship of the gripper tip with respect to the gripper pad, so that this new setting must be adjusted by loosening and adjusting the position of the complete sheet gripper. Then, when tightening the clamping screw, the desired setting changes again, perhaps minimally but still too much. It is extremely important that all sheet grippers on one gripper spindle contact the gripper pad (to clamp the print material therebetween) at exactly the same time, and then lift off during the sheet transfer to the next cylinder in the sequence at precisely the same time. Only then is a register-accurate sheet tranfer possible.

From German patent document DE-PS No. 670 298 a loosely arranged sheet gripper on a swivel spindle is known for printing presses. It embodies the same disadvantages concerning gripper exchange as does the previously referenced patent document DE-PS No. 23 07 126. In addition, there is no adjustment of the gripper tip with respect to the gripper pad, also called the gripper support, foreseen in this design. It is however, impossible to manufacture the recess in the gripper spindle and the groove depth in the gripper back with respect to the location of the bore in such an accurate manner that the many grippers which sit on a gripper spindle are all with their tips in one direction, especially in view of the manufacturing tolerances which multiply in difference due to the high ratio from the gripper pad to the gripper tip. Also, any possibility of proper balancing is completely missing, and further, the flat spring and its arrangement are very unsuitable to exert an accurately defined force onto the gripper tip. As has been pointed out, it is very important that each gripper on a gripper spindle grab the print material with exactly the same force.

The sheet gripper design disclosed by German patent document DE-PS No. 27 25 035 requires a gripper spindle which is very expensive to form because a surface for supporting the adjusting screw, and a step or groove for supporting the sheet gripper, are required in addition to the threaded bores for each gripper (on one gripper spindle there may be up to 20 sheet grippers, depending on format width of the press). An especially costly manufacturing step arises for this design because the gripper spindle must be machined from stock having a diameter which equals the distance between the tip of the step and the center line of the gripper spindle. A mounting of these steps as individual pieces on the gripper spindle would be equally costly, because all of the steps on the spindle must be precisely aligned with each other.

Also, in this last-mentioned design, the bearing blocks of the gripper spindle must be constructed in a split design, because a shaft with steps cannot be installed in unitary rather than split bearings as the bearings will not slide over the ends of the shaft to the proper cylindrical locations thereon. This also results in a substantial increase in cost for the overall design. The use of springs for the sheet gripper in the form of a Bellville spring package is also problematic because such packages of individual Bellville springs are quite unstable for dynamic high frequency movements. Even if the spring travel is very small, wear cannot be avoided. Also unfavorable is the relation of the point of spring force application to the distance from the gripper tip. An extremely high spring force is required to reach the necessary holding force at the gripper tip, which is between 8 and 10 kg, as above mentioned. Still another disadvantage is the manner of mounting of the sheet gripper to the gripper spindle. Since the same screw which fastens the sheet gripper also adjusts the spring force, this screw cannot be tightened completely. This results in quite some insecurity of mounting, although the Bellville springs have a certain countereffect. Nevertheless, an evenly metered holding force for all sheet grippers is difficult to set because the requisite sensitivity is not provided.

The above and other shortcomings of the prior art alleviated by the present invention which provides a sheet gripper that is formed open such that it encloses the gripper spindle through a maximum arc of 180° and is secured by an open drive dog or carrier which is rigidly connected by means of a screw to the gripper spindle. The gripper is retained by being pressed against the gripper spindle, being radially centered with respect thereto, by a compression spring located to one side of the gripper spindle and an adjusting screw located to the other side of the gripper spindle. Contact surfaces which are effective in both axial directions along the length of the spindle are provided for centering of the sheet gripper with respect to the drive dog. The invention may advantageously contemplate the sheet gripper being formed to include a box portion that is open to the outside or radially away from the spindle. The drive dog or carrier is then housed to a large extent within the enclosing surfaces of the box portion which are also the sidewalls of the gripper. The inner sides of these gripper sidewalls serve as the contact surfaces that are formed to determine the location or position of the gripper with respect to the spindle. The bottom of the box portion is open in its circumferential center and a portion of the drive dog or carrier protrudes into this opening to provide a partial enclosing surface ot engage the gripper spindle. The mounting screw of the drive dog passes through this enclosing surface to secure the drive dog on the spindle and thereby captively retain the gripper.

In the design according to the invention, the sheet gripper is pressed onto the gripper spindle with its enclosing surface, which defines a maximum arc of 180° (i.e. the form of a half-cup), by means of the compression spring and the adjusting screw which are cooperable with the gripper and the drive dog. The gripper behaves like an individual gripper with springs when the print material is gripped upon common closing of the complete gripper system, whereas the drive dog is fixed in its position on the gripper spindle by its fastening screw. On one side of the spindle, the drive dog or carrier supports the compression spring which biases the sheet gripper onto the gripper spindle. The adjusting screw is screwed into a threaded bore formed in the drive dog to provide for fine adjustment of the gripper tip engagement on the gripper pad. The bias of the compression spring between the drive dog and the sheet gripper prevents loosening of the gripper during closing or opening thereof. The exchange of one or several grippers is very simple: only the screw which holds the drive dog on the gripper spindle need be removed and reinstalled, and the gripper changeout thus is completed without need of a special serviceman, because the gripper spindle bearings and the gripper spindles themselves remain in their housing within the cylinder gap.

For one preferred embodiment of the invention it is recommended to include on the two longitudinal sides of the drive dog, protruding bars or strip portions for determining the axial location of the sheet gripper with respect thereto. With this feature, it is not necessary to machine the complete longitudinal sides of the drive dog to the close tolerances required for a contact surface, but only the two substantially shorter length opposed sides of the two protruding strips.

Preferably, the sheet gripper and the drive dog are arranged on the side of the gripper spindle opposite to the closing direction of the gripper tip, and the compression spring is located between the gripper spindle and the gripper tip while the adjusting screw is located on the other side of the gripper spindle adjacent the free ends of the sheet gripper and the drive dog. If the gripper spindle center must be located close to the outer radius of the cylinder carrying same, the drive dog and the screw would protrude outwardly of the cylinder radius, a situation which for several reasons cannot be tolerated. In such a machine, the invention can be realized by arranging the sheet gripper and the drive dog on the radially inner side of the gripper spindle (i.e. the side facing the closing direction of the gripper tip), with the relative positions of the spring and the adjusting screw reversed so that the compression spring is positioned on the side of the gripper spindle opposite its location for the other above-described preferred embodiment, i.e. between the free ends of the sheet gripper and the drive dog.

It is therefore one object of the invention to provide a sheet gripper which can be removed and reinstalled without disassembling and removing the gripper spindle and its bearing blocks, which centers on the gripper spindle itself by encompassing up to 180° of the perimeter of the spindle, but is supported without play, has little weight, is finely adjustable in gripper bite or holding force, and is, consequently, capable of exerting an accurately predetermined holding force. The invention also permits the sheet gripper to be easily exchanged by non-experts because of the ease of removing and reinstalling same.

These and other objects and further advantages of the invention will be more readily understood upon consideration of the following detailed description and the accompanying drawings, in which.

In all figures of the drawings, like parts are indicated by like reference numbers, even though embodied in different embodiments of the invention.

Figure 1:
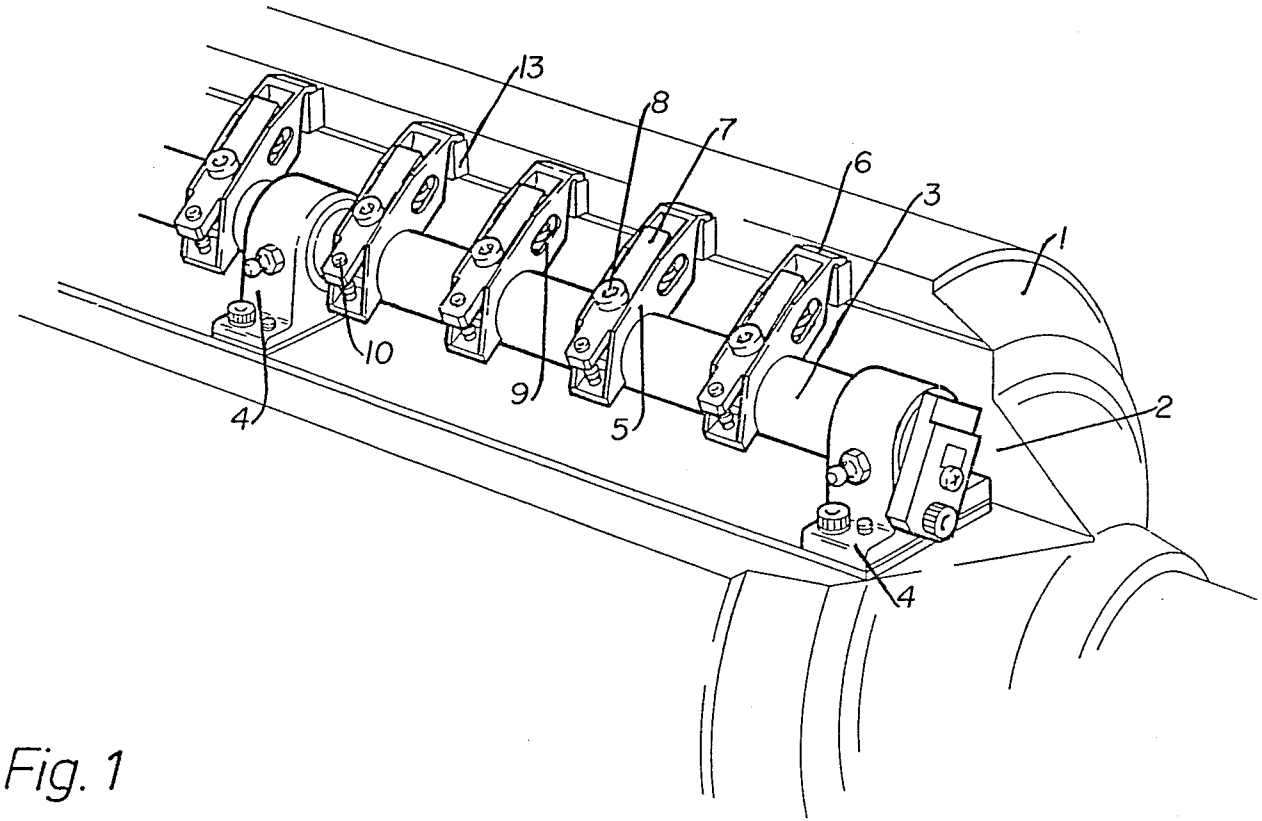
FIG. 1 is a fragmentary perspective view of a cylinder having a gap with a complete gripper system installed into it.
Figure 2:
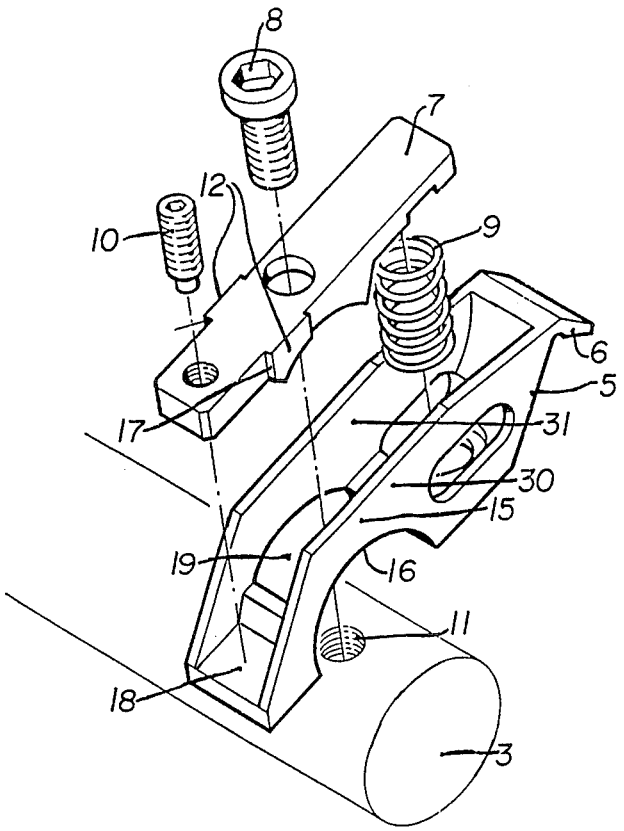
FIG. 2 is a perspective exploded view of a complete sheet gripper assembly according to one presently preferred embodiment of the invention.
Figure 3:
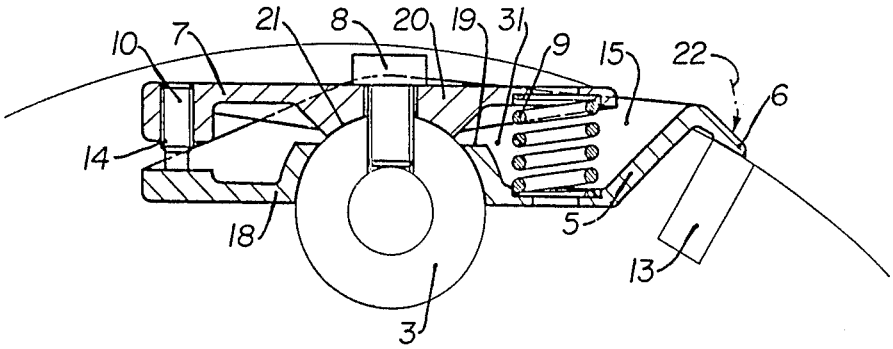
FIG. 3 is a sectional view of the sheet gripper assembly according to FIG. 2.
Figure 4:
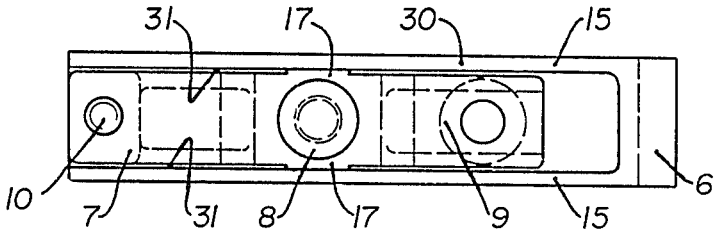
FIG. 4 is a top plan view of the sheet gripper of FIG. 3.

There is illustrated at 1 in FIG. 1 an impression, transfer, or other cylinder member which is utilized to transfer a sheet-form member such as a sheet of print carrier (not shown). Cylinder 1 includes the usual cylinder gap 2 in which there is mounted a gripper spindle 3 supported in a plurality of gripper spindle bearings 4. Referring to FIGS. 1 through 4, mounted on the gripper spindle 3 are plural sheet gripper members 5, which extend transversely of spindle (3) and include gripper tips 6 that cooperate with respective gripper pads 13, and which are secured to gripper spindle 3 by drive dogs 7 which are, in turn, mounted on the gripper spindle 3 by means of screws 8 threaded into bores 11 (FIG. 2) to connect the drive dogs 7 fixedly to the gripper spindle 3. Between each sheet gripper 5 and the respective drive dog 7 is a compression spring 9 and an adjusting screw 10 which is screwed into a threaded bore 14 (FIG. 3) of the drive dog 7.

Sheet gripper 5 is formed generally as an elongated box structure 30 that is open to the outside or radially away from spindle 3. Arcuate enclosing surface 16 are formed in the sidewalls 15 of box structure 30 of the sheet grippers to define an arc of 180° maximum so as to enclose a circumferential portion of spindle 3. Structure is provided for centering each gripper 5 with respect to drive dogs 7 and includes on the one hand inside contact surfaces 31 of sidewalls 15 and, on the other hand, protruding strips 17 formed on the two longitudinal sides of the drive dog 7, and having opposed contact surfaces 12 which in assembly lie close adjacent the surfaces 31 of the sidewalls 15 to locate sheet gripper5 with respect to drive dog 7, and thus to locate gripper 5 axially with respect to spindle 3.

In the bottom 18 of box structure 30 is an opening 19 formed by an interruption in bottom 18 conicident with the circumferential center of the enclosing surfaces 16, and into this opening 19 projects a strip portion 20 of drive dog 7 with an arcuate enclosing surface 21 for engagement with the gripper spindle 3. A fastening means such as a screw 8 is passed through a bore formed in the center of the surface 21 and into the respective threaded bore 11 in spindle 3.

As shown in FIGS. 1 through 4, sheet gripper 5 and drive dog 7 are arranged on the radial side of the gripper spindle 3 which is opposite to or oriented away from the clsoing direction of the gripper tip 6 as marked with an arrow 22 (FIG. 3), and the compression spring 9 lies between gripper spindle 3 and gripper tip 6, while the adjusting screw 10 is located on the other side of the gripper spindle 3, so as to extend between the free ends of the sheet gripper 5 and the drive dog 7.

Figure 5:
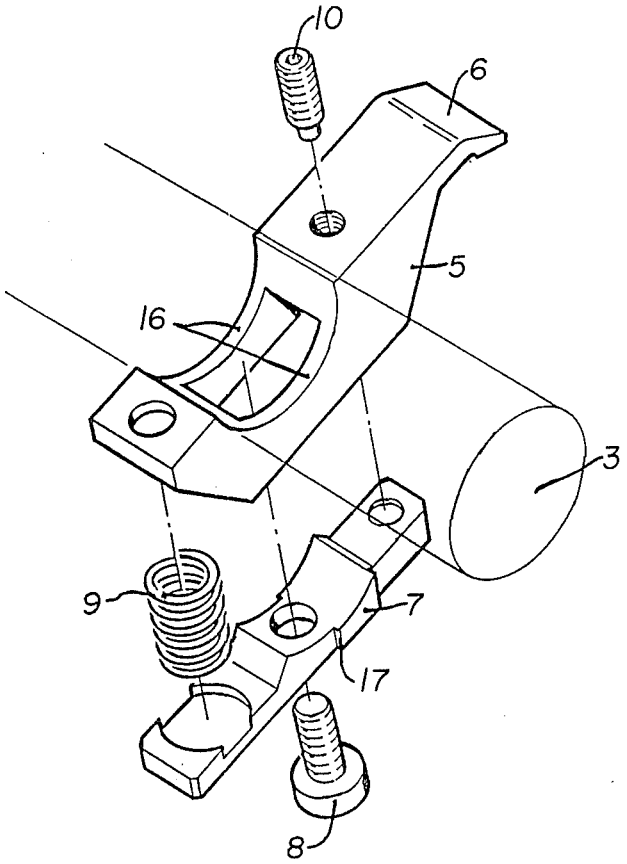
FIG. 5 is a perspective exploded view of a complete sheet gripper assembly according to another presently preferred embodiment of the invention.
Figure 6:
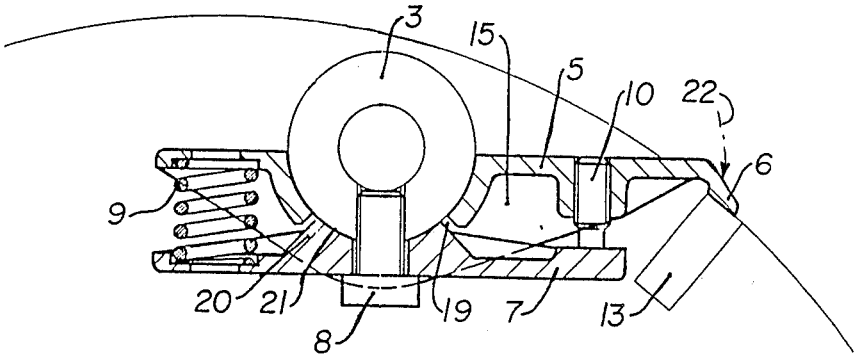
FIG. 6 is a sectional view of the sheet gripper assembly according to Fig. 5.
Figure 7:
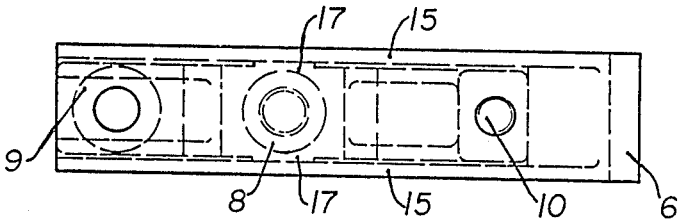
FIG. 7 is a top plan view of the sheet gripper of FIG. 6.

In the embodiment of the invention shown in FIGS. 5 through 7, the arrangement has been made in exactly the opposite way, with the sheet gripper 5 and drive dog 7 mounted on the radial side of gripper spindle 3 which faces toward the closing direction 22 (FIG. 6) of the gripper tip 6. In this embodiment, adjusting screw 10 lies between gripper spindle 3 and gripper tip 6 and the compression spring 9 lies on the other side of the gripper spindle 3, i.e. between the free ends of sheet gripper 5 and drive dog 7. Otherwise, the embodiment of FIGS. 5–7 is similar in all salient respects to that disclosed above with references to FIGS. 1–4.

In both embodiments, compression spring 9 works against the rigidly mounted drive dog 7 as shown to bias gripper tip 6 toward engagement with gripper pad 13 while screw 10 is adjustable to adjust the free or disengaged position of gripper 5 with respect to the rotary position of spindle 3, and thus also with respect to gripper pad 13. As shown, rotation of spindle 3 in the gripper closing direction 22 causes dog 7 to compress spring 9 thus biasing gripper tip 6i nto biased engagement with gripper pad 13 to clamp an edge portion of the sheet-form member therebetween.

Of course, I have envisioned and contemplated other alternative and modified embodiments of the invention, and such would certainly also occur to those versed in the art once apprised of my invention. It is therefore my intent that my invention be construed broadly and limited only by the scope of the claims appended hereto.

I claim:

1. In a sheet gripper mountedd on an elongated gripper spindle in a sheet-processing machine, the combination comprising:

a sheet gripper means (5) including a gripper tip (6);

said sheet gripper means including an enclosing surface means (16) which encloses a partial peripheral portion of the circumferential periphery of the gripper spindle (3) and is firmly and radially centered on the gripper spindle (3) so as to extend transversely thereof in opposite directions;

a drive dog (7) fixedly, releasably connected to the gripper spindle (3) adjacent said partial peripheral portion and cooperable with said sheet gripper means (5) to retain the same with respect to the spindle (3);

a compression spring (9) located transversely to one side of the gripper spindle and engaged in compression between said sheet gripper means (5) and said drive dog (7), and an adjustment screw (10) located transversely to the other side of the gripper spindle; and said sheet gripper means (5) and said drive dog (7) including cooperable contact surfaces formed to be effective for axially locating said sheet gripper means with respect to the spindle (3).

2. The combination as claimed in claim 1 wherein said sheet gripper (5) and said drive dog (7) are arranged on the radial side of the gripper spindle (3) which is opposed to the closing direction (22) of said sheet gripper (5) with respect to gripper tip (6), and said compression spring (9) lies between the gripper spindle (3) and said gripper tip (6), with said adjustment screw (10) located on the other side of the gripper spindle (3) and extending intermediate the respective end portions of said sheet gripper means (5) and said drive dog (7) opposite said one longitudinal end of said sheet gripper means (5).

3. The combination as claimed in claim 1 wherein said sheet gripper (5) and said drive dog (7) are arranged on the side gripper spindle (3) facing toward the closing direction (22) of said gripper tip (6), and said fastener (10) lies between gripper spindle (3) and gripper tip (6), with said compression spring (9) located on the other side of the gripper spindle (3) and extending intermediate the respective end portions of said sheet gripper means (5) and said drive dog (7) opposite said one longitudinal end of said sheet gripper means (5).

4. The combination as claimed in either of claims 2 or 3 wherein said sheet gripper means (5) is formed as a box structure (30) open to the outside and having sidewalls (15) which define a pair of enclosing surfaces (16) for enclosing said peripheral portion of the gripper spindle (3); said sidewalls (15) being spaced apart to recieve therebetween said drive dog (7) whereby said inside surfaces (31) of said sidewalls (15) seerve as said contact surfaces of said sheet grippermeans (5) to determine the axial position of said sheet gripper means (5) with respect to the spindle (3), and the bottom portion of said box structure (30) including an interruption (19) intermediate the ends thereof such that a strip portion (20) of said drive dog (7) protrudes into said interuuption (19) such that an enclosing surface (21) thereon engages the gripper spindle (3), and in said strip portion (20) is received said removable fastener (8) for engagement in a bore (11) formed in spindle (3) to secure said drive dog (7) and said sheet gripper means (5) with respect to the gripper spindle (3).

5. The combination as claimed in claim 4 wherein said drive dog (7) includes on the opposed longitudinal sides thereof protruding, axially oriented portions (17) defining contact surfaces (12) which cooperate with said inside surfaces (31) of said sidewalls (15) to axially locate said sheet gripper means (5) with respect to the spindle (3).

6. The combination as claimed in claim 5 wherein siad removable fastener (8) is a threaded screw fastener.

7. The combination as claimed in claim 1 wherein said drive dog (7) is fixedly connected to the gripper spindle (3) by means of a removable fastener (8) engaged in the gripper spindle (3)

* * * * *